United States Patent [19]

Sierra et al.

[11] 3,946,692

[45] Mar. 30, 1976

[54] DEVICE FOR CLEANING SHIP'S HULLS AND OTHER IMMERSED SURFACES

[75] Inventors: Charles Sierra; Pierre Pince, both of Marseille, France

[73] Assignee: Phoceenne Sous Marine - PSM Les Hommes Grenouilies Du Port De Marseille, Marseille, France

[22] Filed: Dec. 20, 1974

[21] Appl. No.: 535,126

[30] Foreign Application Priority Data

Dec. 28, 1973 France ..... 73.46978

[52] U.S. Cl. ..... 114/222

[51] Int. Cl.[2] ..... B63B 59/00

[58] Field of Search ..... 114/222; 15/1.7, 180, 385

[56] References Cited

UNITED STATES PATENTS

| | | | |
|---|---|---|---|
| 1,213,091 | 1/1917 | Ganz | 114/222 |
| 2,021,608 | 11/1935 | Petty | 15/180 |
| 3,088,429 | 5/1963 | Johannessen | 114/222 |
| 3,678,529 | 7/1972 | Woods et al. | 15/180 |

FOREIGN PATENTS OR APPLICATIONS

| | | | |
|---|---|---|---|
| 1,580,337 | 9/1969 | France | 114/222 |
| 1,226,605 | 3/1971 | United Kingdom | 114/222 |

*Primary Examiner*—Duane A. Reger
*Assistant Examiner*—Stuart M. Goldstein
*Attorney, Agent, or Firm*—Donald D. Jeffery

[57] ABSTRACT

A device for cleaning immersed surfaces comprising a supporting structure carrying rotary circular brushes for cleaning the surface and wheels for moving the device on the surface. When rotated the brushes produce a force of attraction towards the surface. Transmission means, for example, calibrated springs, transmit to the wheel a predetermined part of the force of attraction so that the force with which the brushes are pressed against the surface is diminished and the adhesion of the wheels to the surface is ensured.

8 Claims, 8 Drawing Figures

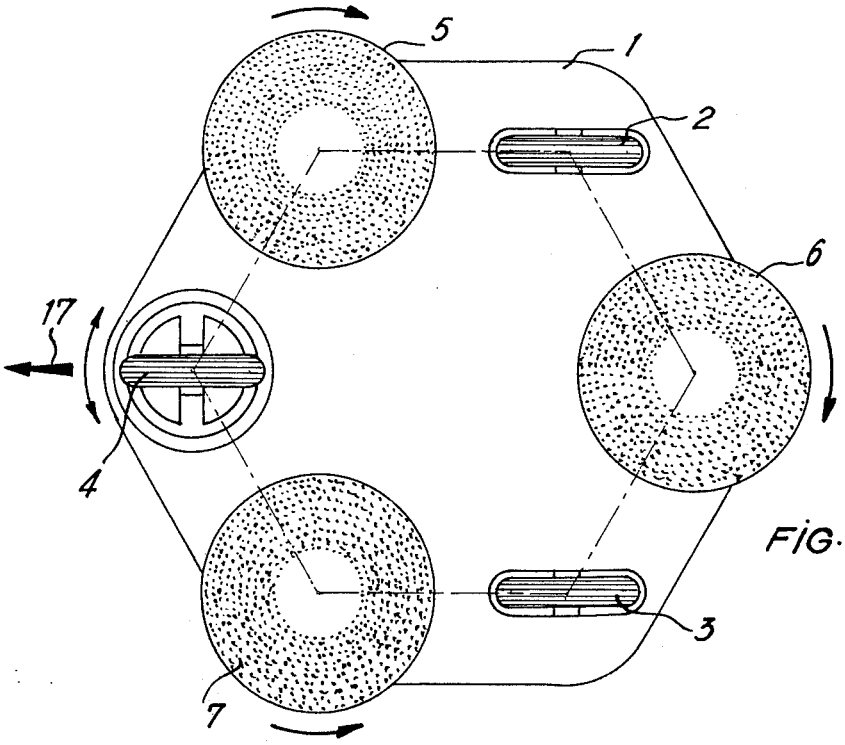
FIG. 1
FIG. 2
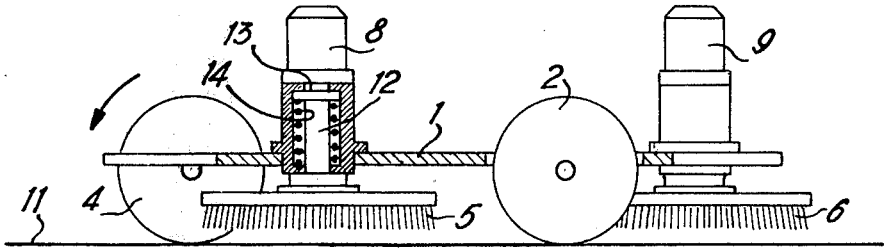
FIG. 3
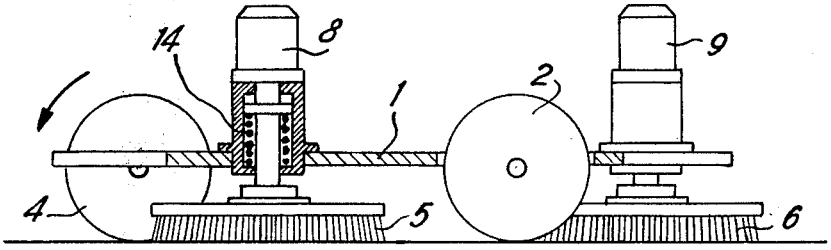

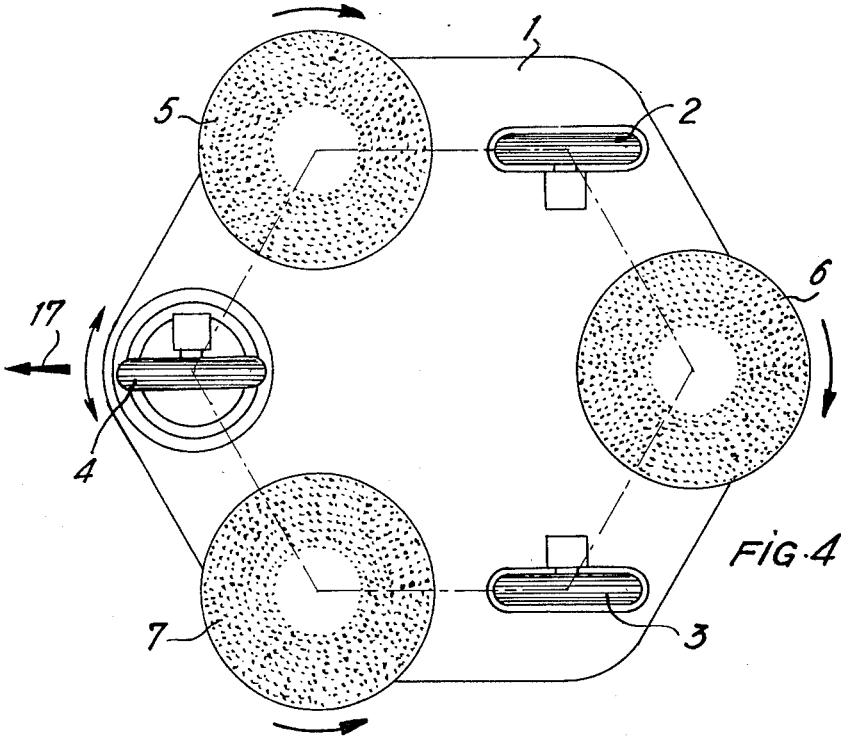
FIG. 4
FIG. 5
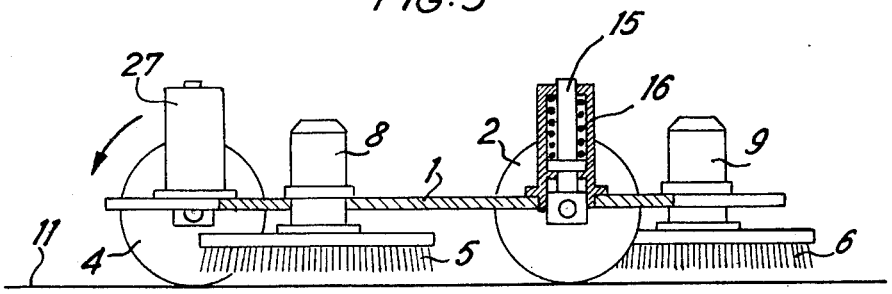
FIG. 6
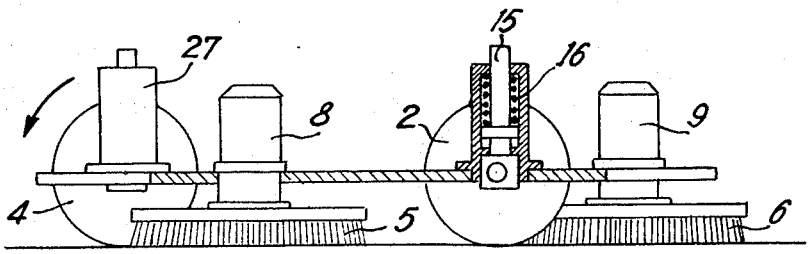

DEVICE FOR CLEANING SHIP'S HULLS AND OTHER IMMERSED SURFACES

The present invention concerns a device for cleaning ship's hulls and other immersed surfaces.

This device is designed in particular for cleaning the hulls of tankers the surfaces of which are mainly plane or have a very slight curvature, and are of large areas.

Devices are known for cleaning an immersed surface comprising a supporting structure on which are mounted rotary circular brushes for cleaning the surface and wheels enabling the device to be moved on the surface.

In these devices, the thrust necessary for ensuring adhesion of the wheels against the surface is supplied by one or more propellers or by a turbine.

The present invention uses the force of attraction created by the powerful suction of the circular brushes for ensuring the adhesion of the wheels against the surface being cleaned.

According to the present invention there is provided a device for cleaning an immersed surface, comprising a supporting structure carrying brushes for cleaning the surface and wheels for moving the device on the surface the brushes being adapted to produce a force of attraction towards the surface in use when rotated, and transmission means on the structure which, when the device is in use, transmit to the wheels a predetermined part of the force of attraction so that the force with which the brushes are pressed against the surface is diminished to obviate flattening of the bristles against the surface and whereby adhesion of the wheels to the surface is ensured.

Preferably the brushes have tufts of bristles arranged so as to form curved passages widening towards the outside, between rows of tufts so as to facilitate the channelling of fine streams of water from the centre to the outside as the brushes rotate.

The transmission means may be advantageously formed of calibrated springs, the amount of the compression of the springs determining the thrust of the wheels. It is recommended that a zone free from bristles should be left at the centre of the brushes to form a cavitation zone in which a powerful suction is produced.

Embodiments of the invention will now be described, by way of example, with reference to the accompanying drawings, in which:

FIG. 1 is a view from below of a first brushing device according to the present invention;

FIGS. 2 and 3 are side views in part section of the brushing device of FIG. 1, respectively before setting the brushes in operation and during the rotation of the brushes;

FIg. 4 is a view from below of a second brushing device according to the invention;

FIGS. 5 and 6 are side views with partial section of the brushing device of FIG. 4, respectively before setting the brushes in operation and during the rotation of the brushes;

Figure 7:
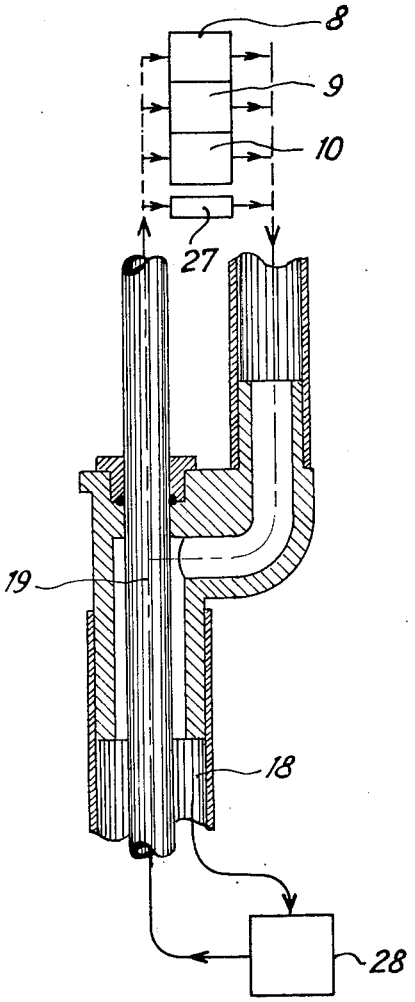
FIG. 7 is a diagrammatic view of the means for feeding and discharging the hydraulic fluid for driving the brushes.

The device comprises a plate 1 carrying three circular brushes 5, 6 and 7 and three wheels 2, 3 and 4, two of which are free and one is a driving and steering wheel.

The wheels and brushes are arranged at the apexes of a hexagon so as to obtain stability and an even distribution of pressure.

Each brush is driven by a separate hydraulic motor which forms part of the device. These motors are indicated by the reference numerals 8, 9 and 10 in the drawings.

Figure 8:
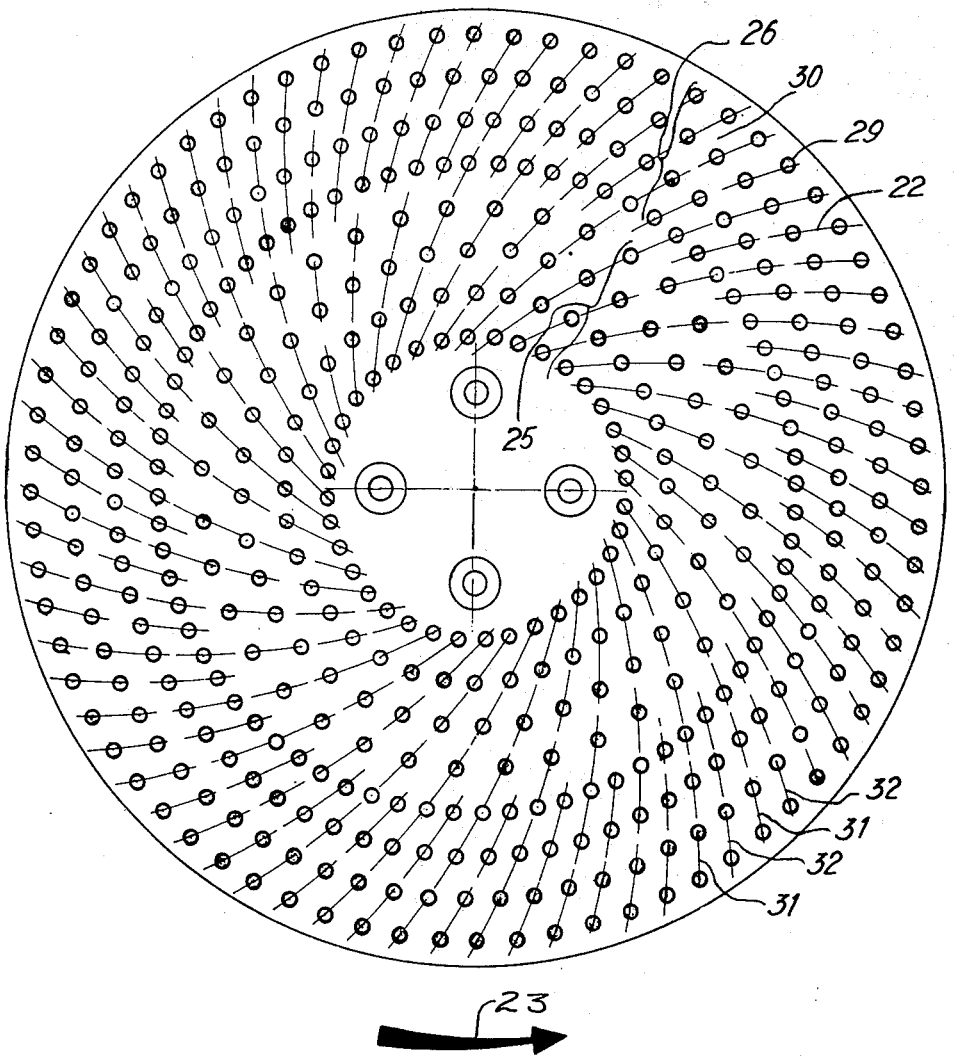
FIg. 8 is a view from below of one of the brushes, showing the distribution of the bristles of the brush.

The three brushes are driven at the same speed and each brush rotates in a particular sense according to the direction of inclination of the channels formed between rows of bristles, as is shown in FIG. 8.

The brushes are mounted so that when the brushes are not rotating and when the wheels rest on a plane wall, such as the wall 11 which bears the surface to be cleaned (see FIGS. 2 and 5), they are spaced from the wall by a distance of 20 to 40 mm.

In the embodiment of FIGS. 1 to 3, the brushes are fixed to sleeves, such as the sleeve 12 of the brush 5, which are mounted for translational movement with respect to the structure 1. The sleeves slide on the brush-driving shafts, such as the shaft 13 of brush 5, which are coupled to the motors. The brush-driving shafts and the sleeves are splined together to transmit the torque of the motors to the brushes. When the brushes are rotated, the suction created between the brushes and the surface to be cleaned creates a force of attraction towards the surface which is exerted on the brushes causing them to move towards the surface. In moving towards the surface, the brushes compress calibrated springs such as the spring 14 for brush 5 which transmit part of the force of attraction to the wheels. The calibration of the springs is such as to avoid crushing of the bristles and to ensure a suitable pressure of the wheels on the surface to be brushed (FIG. 3).

In the embodiment of FIGS. 4 to 6, the brushes are fixed so that they cannot slide relative to the structure, but the structure can slide relative to the wheels. The shaft of each of the wheels is in fact secured to a rod such as the rod 15 of the wheel 2 which may slide relative to the structure 1 while compressing a calibrated spring 16. This being so, when the brushes rotate, a fraction of their force of attraction is transmitted to the wheels, this fraction corresponding to the amount of the compression of springs 16, such that the result is the same as that obtained in the case of the device of FIGS. 1 to 3.

The hydraulic motors 8 to 10 which drive the brushes are carried by the structure and supplied with oil or other hydraulic fluid by a flexible pipe 19 (high pressure) (FIG. 7) housed in another flexible pipe 18 (low pressure) for the circulation of the oil after passing through the motor for its return to the source of oil and its recycling. The diameter of the pipe 18 is calculated while taking into account the density of the oil, to ensure buoyancy of the set of pipes, so that the weight of this set of pipes does not interfere with the moving of the device in the water. Connections at each end of the set of the two pipes enable the latter to be connected to the source of oil 28 on the one hand and to the motors 8, 9, 10 and 27 on the other hand. Since it is the external pipe which serves for returning the oil to the source of supply, the arrangement has the additional advantage of cooling of the returning oil by the seawater from which it is separated by only the wall thickness of pipe 18.

FIG. 8 shows the distribution of the tufts of bristles of a brush which is considered to give the most satisfactory results. The particular feature of this distribution is that the tufts 29 lie on portions of spirals 22 opening towards the exterior of the brush and the function of which is to form between them curved flow channels 30 flared towards the exterior. These channels, during rotation of the brush in the direction of the arrow 23, guide fine streams of water from the centre of the brush to the exterior, so that the centre of the brush which is free from bristles forms cavitation zones in which a powerful suction is produced.

In this example, the tufts of the brush, represented diagrammatically by the circles 29, are each formed by 22 lengths of steel wire 0.6 mm in diameter or by 30 lengths of nylon thread 1 mm in diameter, the length of the wires or threads being from 40 to 50 mm.

Starting from the centre of the brush, there is a first series of four circles 25, each comprising the same number of evenly distributed tufts, for example, 36, then a second series of four circles 26 each comprising also the same number of tufts, this number being greater than that of the first series of circles and being for example double that number.

It will be seen in FIG. 8 that the tufts of bristles of a brush are distributed both on concentric circles 25 and 26 and on two sets of non-secant curves, the curves 31 of the first set starting from the innermost circle, passing to the outermost circle and each comprising a tuft on each circle, and the curves 32 of the second set starting from an intermediate circle between the innermost circle and the outermost circle, going to the outermost circle and being interposed between the curves 31.

The brush diameter is for example 400 mm with an empty space at the centre of 120 mm.

The disc carrying the bristles may be a disc of wood, plastics or hard rubber.

Preferably, the brushes are caused to rotate at a speed between 700 and 1200 rev/min. In the case of the brush shown, there is obtained with a rotary speed of 800 rev/min a force of attraction of each brush of 220 kg, i.e. a total force of attraction of 660 kg which is transmitted partly to the brushes for ensuring efficient cleaning and partly to the wheels for enabling them to ensure the propulsion and displacement of the device.

The driving wheel 4 is driven by a hydraulic motor 27 fed like the brush-driving motors.

To facilitate manipulation of the device by a diver, provision is made to fix a float to the centre of the device to give the device a slight positive buoyancy. The float may be of expanded polyurethane.

We claim:

1. A device for cleaning an immersed surface, comprising:

a supporting structure carrying wheels for moving the structure on said surface and carrying driving means for driving rotary brushes, and a plurality of rotary circular brushes driven by said driving means, each brush being fixed to a sliding axial member which bears on the structure through a calibrated spring, said spring being compressed by the sliding of the said axial member in response to the rotation of said brush, each of said rotaty circular brushes having bristles for cleaning the surface and a central space which is free of bristles, the bristles of each brush being arranged in tufts which are distributed between said central space and the periphery of the brush in rows so as to define flow channels which are flared towards the periphery of the brush, said flow channels conducting streams of water from the central space to the periphery of said brush.

2. the device of claim 1 wherein said tufts are arranged on concentric circles, the tufts on each circle being evenly distributed.

3. The device of claim 2 wherein all circles have the same number of tufts.

4. The device of claim 2 wherein there are two series of concentric circles, all the circles of each series having the same number of tufts, circles of different series having different numbers of tufts.

5. The device of claim 4 wherein starting from the central space, the brush comprises four successive circles each of 36 tufts of bristles, followed by four successive circles each of 72 tufts of bristles.

6. The device of claim 1 wherein said tufts are located at the intersection of concentric circles with two sets of non-secant curves, the curves of the first set extending from the innermost circle to the outermost circle, the curves of the second set being disposed between the curves of the first set and extending from a circle intermediate the innermost and outermost circles to the outermost circle.

7. The device of claim 1 wherein said driving means for said brushes comprises hydraulic motors carried by said supporting structure, and further including a common oil feed pipe for feeding said motors and a common oil return pipe, said oil feed pipe being contained with said oil return pipe, and the diameter of the oil return pipe being such that when filled with oil the pipes are buoyant.

8. The device of claim 1, wherein said axial member comprises a sleeve which slides on a shaft which is rotatively fixed to said supporting structure and which is driven by said driving means.

* * * * *